US007229002B1

(12) United States Patent
Burch, Jr. et al.

(10) Patent No.: US 7,229,002 B1
(45) Date of Patent: Jun. 12, 2007

(54) STRUCTURE AND PROCESS FOR PACKAGING AND SHIPPING PRODUCE

(75) Inventors: William B. Burch, Jr., Marietta, GA (US); John N. Atwood, Fresno, CA (US)

(73) Assignee: RTS Packaging, LLC, Norcross, GA (US)

( * ) Notice: Subject to any disclaimer, the term of this patent is extended or adjusted under 35 U.S.C. 154(b) by 72 days.

(21) Appl. No.: 10/434,554

(22) Filed: May 9, 2003

Related U.S. Application Data

(60) Provisional application No. 60/379,319, filed on May 9, 2002.

(51) Int. Cl.
*B65D 43/02* (2006.01)

(52) U.S. Cl. ..... 229/120; 229/125.01; 229/915; 229/916

(58) Field of Classification Search ..... 229/120, 229/915, 125.01, 125.29, 148, 916; 220/366.1
See application file for complete search history.

(56) References Cited

U.S. PATENT DOCUMENTS

| | | | | | |
|---|---|---|---|---|---|
| 1,352,833 | A * | 9/1920 | Robinson | ..... | 229/125.29 |
| 2,072,753 | A * | 3/1937 | Ikeda et al. | ..... | 229/148 |
| 2,329,605 | A * | 9/1943 | Gladstein | ..... | 229/125.01 |
| 3,184,136 | A * | 5/1965 | Forbes, Jr. | ..... | 229/148 |
| 3,486,680 | A * | 12/1969 | Negus, Jr. | ..... | 229/120 |
| 3,744,707 | A * | 7/1973 | Ross | ..... | 229/125.01 |
| 4,146,167 | A * | 3/1979 | Pascus | ..... | 229/125.29 |
| 4,245,773 | A * | 1/1981 | Stollberg | ..... | 229/915 |
| 4,804,136 | A * | 2/1989 | Hall | ..... | 229/120 |
| 4,984,734 | A * | 1/1991 | Zion et al. | ..... | 229/915 |
| 5,549,241 | A * | 8/1996 | Correll | ..... | 229/915 |
| 6,354,487 | B1 * | 3/2002 | Muise, Jr. | ..... | 229/125.29 |

FOREIGN PATENT DOCUMENTS

| | | | | |
|---|---|---|---|---|
| EP | 548879 | * | 6/1993 | ..... 229/125.29 |

(Continued)

OTHER PUBLICATIONS

Declaration of William B. Burch, Jr. with photos of sample products manufactured by FDS Manufacturing (date unknown).

(Continued)

*Primary Examiner*—Gary E. Elkins
(74) *Attorney, Agent, or Firm*—Kilpatrick Stockton LLP

(57) ABSTRACT

Structures and processes for packaging produce in a manner that resists contamination due to dust, debris, and sunlight. According to certain embodiments of the present invention, fresh produce may be placed in a produce container having tabs extending from the top of the produce container walls. The tabs may preferably comprise a hook end. A produce container cover, preferably made from fiberboard or some other suitably lightweight material, comprising tab slots in locations complementary to the tabs of the produce container may be placed on the produce container as a cover. The tab slots of the produce container cover are configured to create a locking effect with the hook end of the tabs located on the produce container. This prevents the produce container cover from inadvertently being displaced during shipping and handling. According to certain embodiments of the present invention, produce container covers may be configured for use with various produce containers in order to achieve the advantages of the present invention.

7 Claims, 12 Drawing Sheets

FOREIGN PATENT DOCUMENTS

WO WO-85/03687 A1 * 8/1985 ..... 229/125.01

OTHER PUBLICATIONS

IFCO United States brochure entitled "It's Time For . . . The Ultimate Package Deal! The Returnable Fresh Produce Container System," 2 pages.

RTS Packaging, LLC brochure entitled "Partition Products At-A-Glance, Custom Partitions and Protective Packaging Thinking Inside the Box," two pages (undated).

RTS Packaging, LLC brochure entitled "Custom Partitions and Protective Packaging Thinking Inside The Box," 8 pages (undated).

Field Cored Lettuce "FC Lettuce" Best Practices prepared by National Food Processors Association, International Fresh-Cut Product Association, United Fresh Fruit & Vegetable Association, 16 pages (Apr. 23, 2001).

Fibre Box Association brochure entitled Corrugated Common Footprint Standard Technical Specifications, pp. 1-6, 8, 11 (Oct. 2000).

* cited by examiner

STRUCTURE AND PROCESS FOR PACKAGING AND SHIPPING PRODUCE

RELATED APPLICATION

The present application claims the benefit of provisional patent application Ser. No. 60/379,319 filed on May 9, 2002 entitled "Structure and Process for Packaging Produce."

FIELD OF THE INVENTION

The invention relates generally to structures and processes for packaging and shipping produce and more specifically to produce containers and produce container covers that protect produce from dust, debris and light damage during shipping and handling.

BACKGROUND

Conventional supply chains for fresh produce involve the shipment of fresh fruits and vegetables to retail points of sale such as grocery retailers, and more recently to integrated distribution centers for a common chain of grocery retailers. Previously, the containers used for shipping fresh produce included a variety of shapes and sizes, and were made from a variety of materials. For example, fresh produce was shipped in open-top storage bins, corrugated boxes, crates and plastic containers among others. Recently, there has been a movement to standardize the shipment containers for fresh produce in order to maximize the use of shipping pallets and shipping containers. Shipping pallets are typically 40 inches by 48 inches. As a result of this movement, two types of standard shipping containers have emerged. The first is known as Returnable Plastic Containers ("RPC"), made from polyethylene, polypropylene or other suitable plastic material, and the second is a corrugated shipping container. Each of these containers conforms to the accepted industry standard sizes, which are either approximately 23.5 inches by 17.6875 inches or 19.5 inches by 17.6875 inches creating a standard footprint for produce shipping. Depending on which container size is preferred, either five or six containers may fit across a base layer of a shipping pallet.

Supply chain management in the fresh produce industry is rapidly evolving as a result of new technologies and a focus on improved efficiency, quality and safety. These concerns have caused governing bodies, such as the California Table Grape and Tree Fruit League, to require all shipments of certain produce to be shipped covered, rather than open-top. This was done to prevent dust, dirt and light from contaminating the produce, to reduce the risk of pilferage and to otherwise improve the quality of the shipping process. Other benefits include reducing the likelihood of slip and fall accidents due to produce falling out of shipping containers. After seeing the benefits of certain produce being shipped covered, grocery retailers have began to demand that all produce be shipped covered.

Typically, the supply chain for produce shipment involves first harvesting the produce at the farm where it is packed in one of the two above described shipping containers. The containers are preferably covered immediately after they are packed, to reduce the possibility of contamination. The covered containers are shipped to a cold storage facility by truck. Alternatively, the containers may be shipped from the farm to the cold storage facility as open-top containers and then covered at the cold storage facility. The covered containers are then either shipped to a grocery retailer, or a distribution center for a grocery retailer, also by truck. Once the produce arrives at the retailer, it is unloaded from the truck at the loading dock and the covers are discarded. The produce is typically displayed for sale in the containers itself.

In response to demands for eliminating open-top shipping, corrugated covers have been used to cover produce shipments in corrugated containers. Problems have arisen with the use of corrugated covers. The locking feature on the corrugated covers is not very effective, causing the covers to be easily blown off or knocked off the produce shipment boxes when in use. Another disadvantage of corrugated covers is the stiffness of the material, which may cause damage to the produce during shipment. For example, if box were filled with produce and a portion of the produce protruded above the top of the box, the corrugated cover would apply unwanted pressure to the produce, creating undesirable damage. A third disadvantage to corrugated covers is the thickness, which limits the amount of covers which can be shipped in a shipping container or a truck load, as well as the amount of covered boxes which can be stacked in a truck used for shipping the produce. For example, if using corrugated covers, each truck may be stacked only 17 corrugated containers high. The thickness of the corrugated material also causes the corrugated covers to occupy a large amount of warehouse space when stored prior to use, creating increased cost associated with these types of covers. Additionally, corrugated covers have not been configured to accommodate RPC containers.

SUMMARY

Certain embodiments of the present invention provide new structures and processes that overcome the problems previously described. Certain embodiments of the present invention comprise structures and processes for shipping produce in a manner that prevents contamination by dust, debris, and direct contact with sunlight. According to certain embodiments of the present invention, produce may be packed in a produce container comprising a bottom surface, two upstanding side walls, and two upstanding end walls. A plurality of tabs may preferably extend from the top of the side walls of the produce container, but may also extend from the top of the end walls of the produce container. At least one of the tabs preferably comprises a base portion and a hook end. A generally rectangular produce cover may be used to cover the produce container. The produce container cover may preferably comprise a plurality of tab slots of approximately the same length as the tab base. When the produce container cover is placed over the produce container, the tab slots are positioned over the tabs of the produce container. The at least one tab having a hook end secures the produce container cover to the produce container by creating a positive lock. The lock is created due to the length of the tab slot being slightly less than the length of the tab and the hook end. Accordingly, it is an object of the present invention to provide a structure for packaging produce that prevents the produce from being contaminated by dust and debris.

It is another object of the present invention to provide a structure for packaging produce that prevents the produce from being exposed to direct sunlight during shipping.

It is another object of the present invention to provide a produce container and cover that reduces pilferage of the packaged produce.

It is yet another object of the present invention to provide a produce container and cover that does not damage the produce during shipping.

It is still another object of the present invention to provide a produce container and cover that locks together and remains secure during rough shipping and handling environments.

It is yet another object of the present invention to provide a produce container cover that is light weight and made of materials that create efficiencies of scale during storing and shipping.

Other objects, features and advantages of the present invention will become apparent upon review of the disclosure and appended claims.

DETAILED DESCRIPTION

Figure 1:
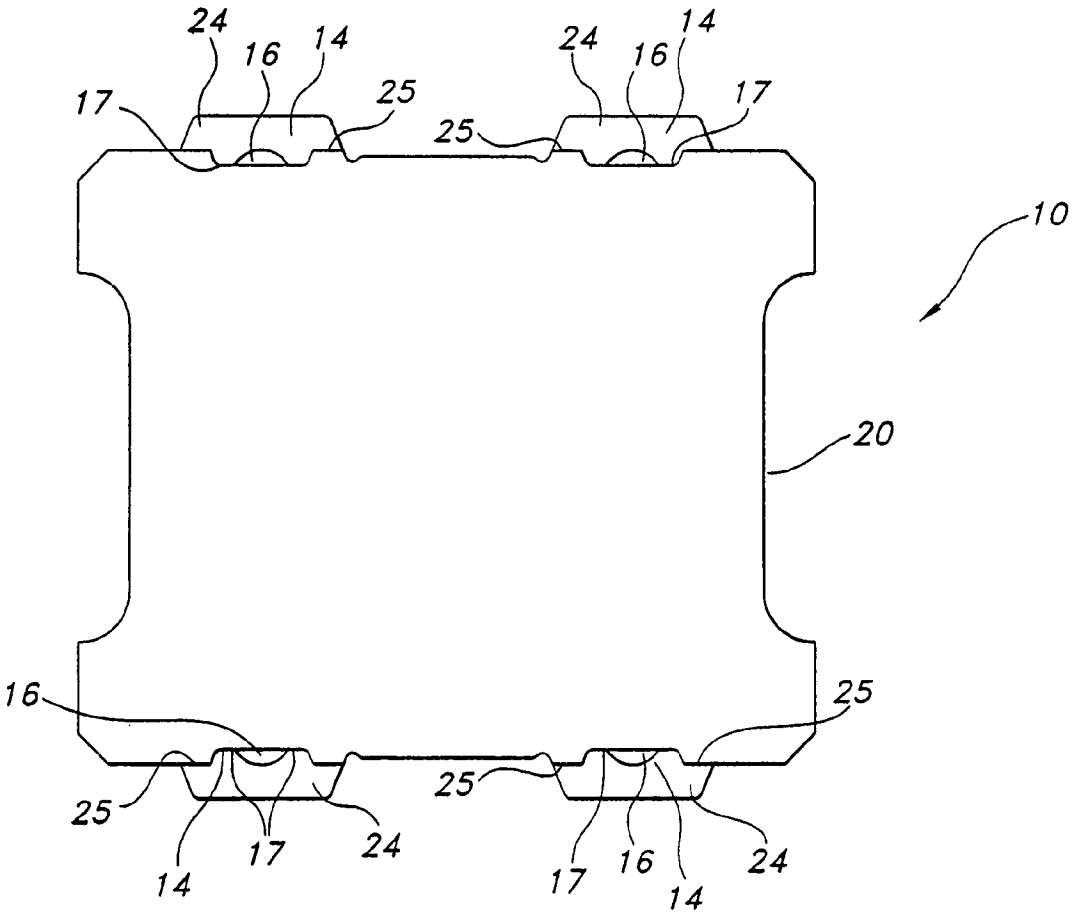
FIG. 1 is a top plan view of a produce container cover according to certain embodiments of the present invention.
Figure 2:
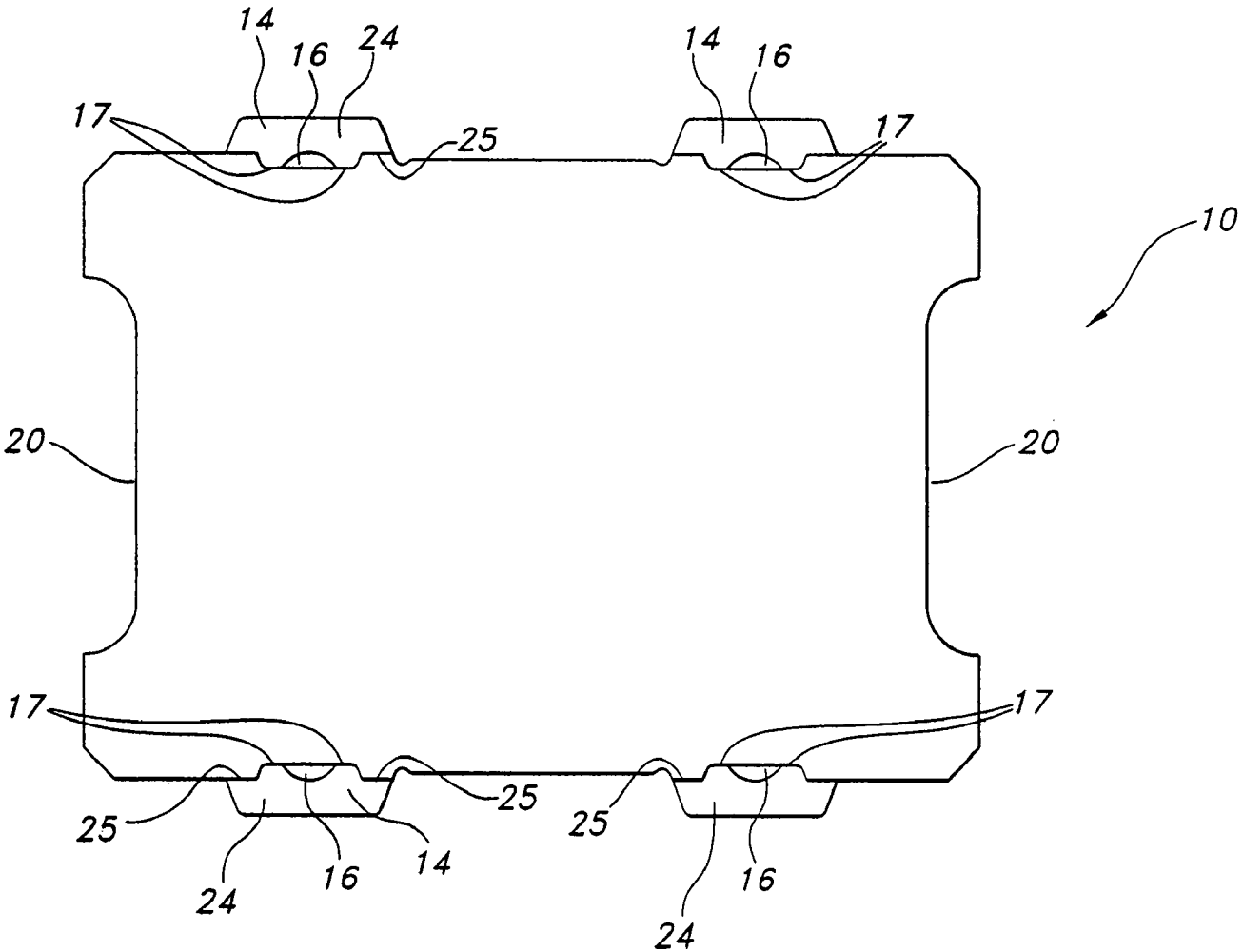
FIG. 2 is a top plan view of a produce container cover according to certain embodiments of the present invention.
Figure 3:
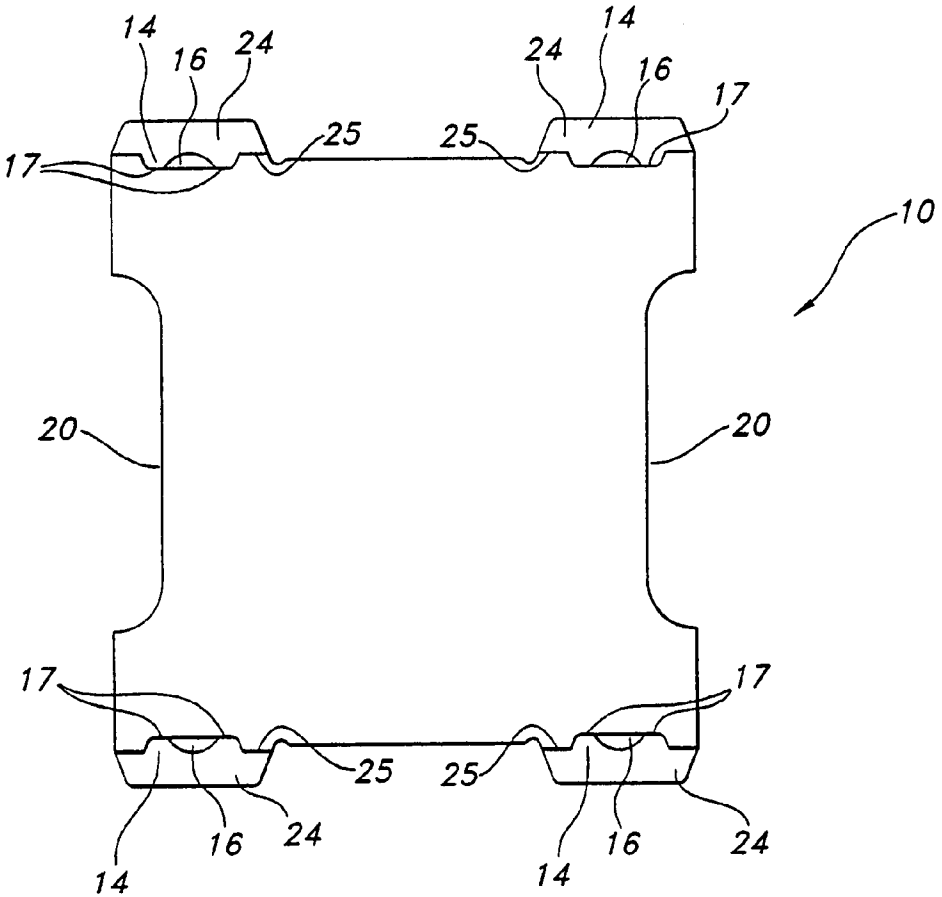
FIG. 3 is a top plan view of a produce container cover according to certain embodiments of the present invention.
Figure 4:
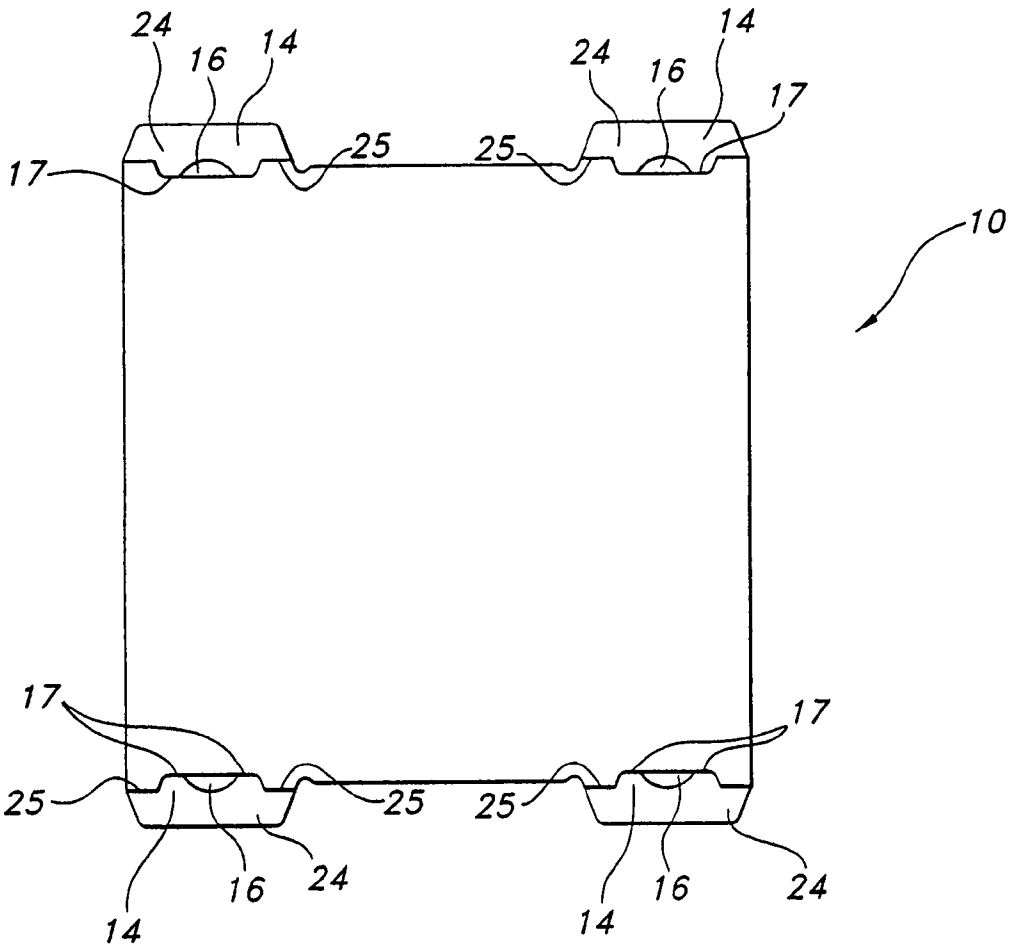
FIG. 4 is a top plan view of a produce container cover according to certain embodiments of the present invention.

Certain embodiments of the present invention provide produce container covers and produce shipping containers at great material cost savings. Certain embodiments of the present invention allow for shipping and storing much larger quantities of produce container covers per unit volume. According to certain embodiments of the present invention, the produce container covers are made from single-ply fiberboard, preferably recycled. 100% recycled paperboard may also be used as well as plastic, films, Styrofoam or other suitably thin material. Fiberboard material is preferable for produce container covers partly because it provides economic advantages over conventional corrugated covers. For example, the typical thickness of a corrugated produce container cover is 0.125 inches as compared to the fiberboard covers according to certain embodiments of the present invention, which are typically 0.024 inches thick. Thus, the conventional corrugated covers are approximately five times thicker than the fiberboard containers according to certain embodiments of the present invention and are more expensive due in part to increased material costs. It should be understood that covers according to certain embodiments of the present invention may be made from paperboard, plastic, films, Styrofoam or other suitably thin material.

The use of fiberboard in forming certain embodiments of the present invention has multiple advantages. According to certain embodiments of the present invention, the fiberboard produce container covers are much more efficient to ship in bulk. For example, when shipping by truck, it is possible to ship approximately 200,000 fiberboard produce containers as compared to only approximately 40,000 corrugated covers due to the difference in material thickness. This also translates into advantages in warehouse storage of fiberboard covers according to certain embodiments of the invention which allow approximately five times more fiberboard covers to be stored per unit volume than conventional corrugated covers. This, in turn, reduces storage cost and warehouse space requirements. Additionally, when used with corrugated produce containers, trucks may be stacked 18 corrugated containers high rather than only 17 high if corrugated covers were used.

Another advantage of fiberboard produce container covers according to certain embodiments of the invention is the flexibility of the material. When placed on top of a produce container, the flexibility of the fiberboard cover allows it to flex upwards in a dome-like manner. This prevents the fiberboard cover from applying unwanted pressure to the produce that may be extending above the top edge of the container, maintaining the produce in salable condition. Additionally, the flexibility of the fiberboard produce container covers allows the covers to be stretched, and prevents tearing, when used with corrugated produce containers as the walls of the corrugated containers may bend outwardly.

Figure 10:
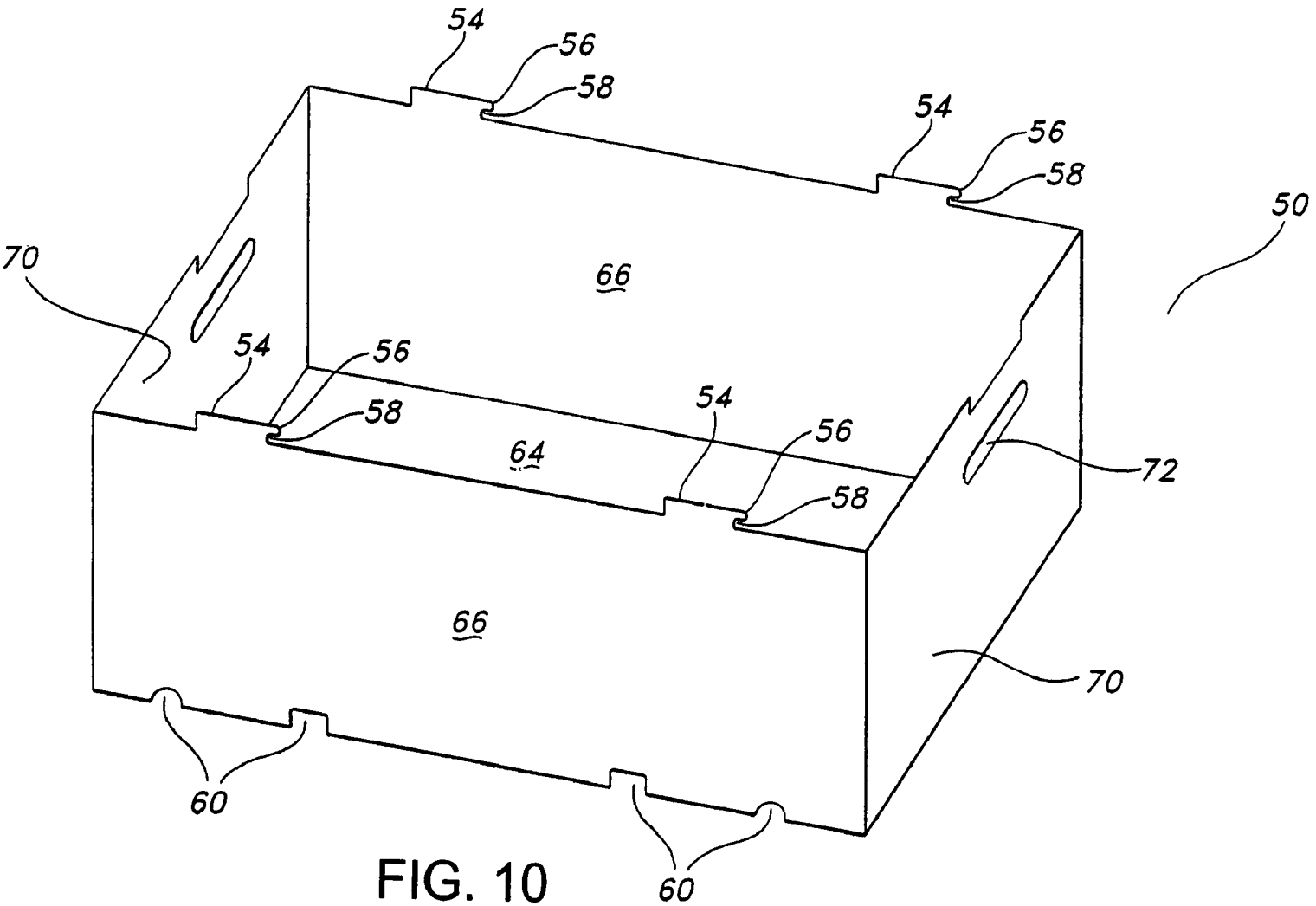
FIG. 10 is a perspective view of a produce container according to certain embodiments of the present invention.

Certain embodiments of the present invention may be used with corrugated produce containers. Corrugated produce containers are made in two different standard footprint sizes. Each corrugated produce container 50 comprises a bottom surface 64, two upstanding side walls 66 and two upstanding end walls 70, preferably forming an open-top rectangular shaped container as shown in FIG. 10. Openings 60 are preferably located in the bottom of the produce container in order to allow ventilation and air circulation throughout the container. The openings are preferably located near the side walls of the produce container and are preferably sized to avoid produce, such as grapes for example, from falling out of the produce container. Four tabs 54 extend vertically from the top edge of the side walls of the corrugated container. The tabs are approximately two inches wide and are of the same thickness as the walls 66, 77 of the corrugated container. Each tab extends vertically approximately 0.5 inches. Two tabs are preferably located on each of the side walls 66 of the corrugated container 50, approximately half way between the mid-point of the side wall and each corner of the corrugated container. A handle opening 72 may be provided on the end walls to facilitate movement of the container 50.

When used with corrugated containers, produce container covers according to certain embodiments of the present invention are typically formed from a fiberboard sheet. As shown in FIG. 1, the produce container cover 10 is generally rectangular in shape. Four tab slots 14 are die-cut into the fiberboard sheet. The tab slots may comprise a semi-circular aperture 16 with a slit 17 on either end. The tab-slots are located towards the corner of the produce container cover and are positioned so that they will align with the tabs of the corrugated produce container when in use. Two elongated sections 20 are die-cut on either end of the produce container cover. This provides visual access to the fruit contained in the fiberboard container and ventilation for the produce. The sides of the produce container cover are die-cut to extend entirely across the width of the corrugated produce container, leaving four folding tabs 24, each located adjacent one of the tab-slots. A tab fold line 25, connecting each folding tab to the produce container cover, allows the folding tabs to be bent downward when in use.

The container cover 10 of certain embodiments of the present invention may be used as a cover for corrugated produce containers. The appropriate size produce container cover is selected with respect to the size of the corrugated produce container. The tab slots 14 of the produce container cover are slipped over the tabs 54 of the corrugated produce container, creating a friction fit between the tabs of the corrugated produce container and the tab-slots of the produce container cover. This creates a locking effect, preventing the produce container cover from easily being displaced from the corrugated produce container due to vibration, wind or handling. The folding tabs 24 are folded downward along fold line 25 so that they are approximately adjacent to the side walls 66 of the corrugated produce container. As stated above, the minimal thickness of the produce container cover provides numerous advantages and cost savings, including, but not limited to, the ability to stack one extra row of boxes inside a produce shipment truck as compared to corrugated covers and the ability for corrugated produce containers to fit more closely together on the pallet due to the minimal thickness of the folding tabs.

According to certain embodiments of the present invention, the produce container 50 and produce container cover 10 may be configured to create a positive lock. As shown in FIG. 10 the tabs 54 of the produce container 50 may be configured with a hook 56 on one end. The hook 56 may be a slight extension of the tab 54 at the top surface of the tab. Each tab, therefore, may have a base portion 58 and a hook end 56. It should be understood that it may be preferable to have a hook end 56 associated with each tab of the produce container, but hook ends associated with fewer than all of the tabs may also accomplish the desired locking effect. It should also be understood that the hook end 56 may be a linear extension of the tab 54, or alternatively the hook end may comprise a curved extension of the tab. The hook end 56 may be formed by creating a rectangular tab and then cutting a portion of one end of the tab to create the hook end, alternatively, the tab may be configured with a hook end.

Figure 11:
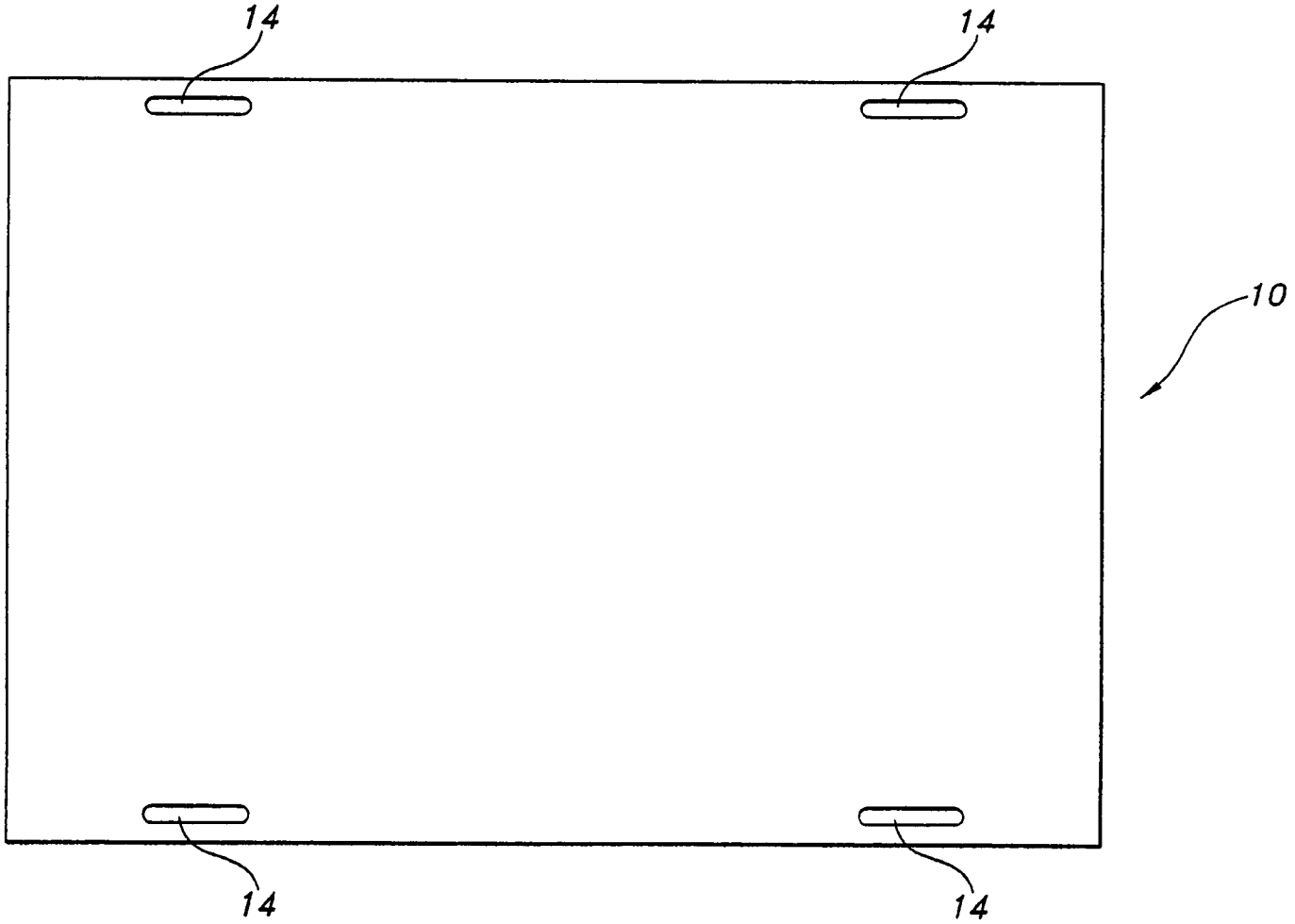
FIG. 11 is a top plan view of a produce container cover according to certain embodiments of the present invention.
Figure 12:
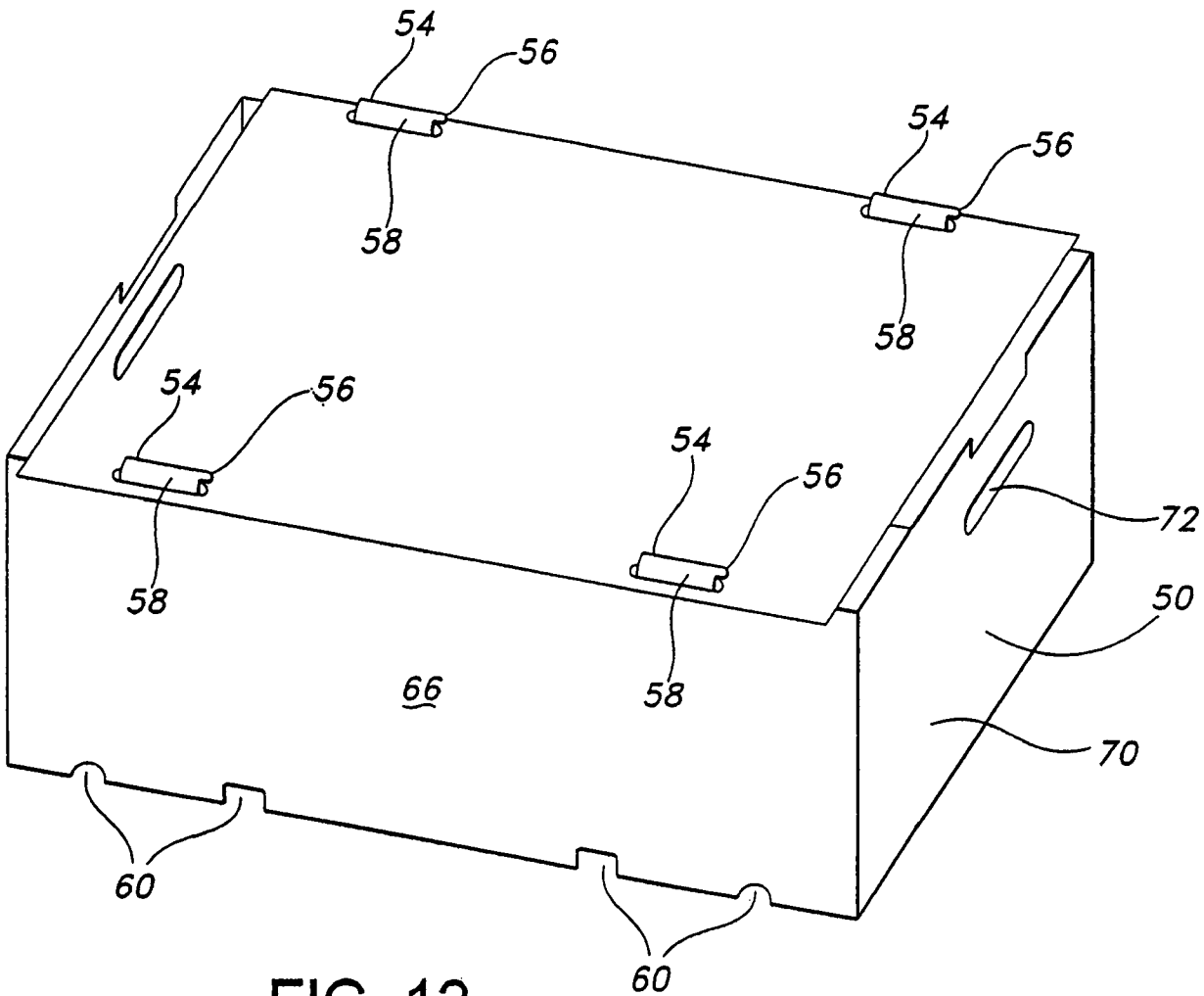
FIG. 12 is a perspective view of the produce container of FIG. 10 and the produce

As shown in FIGS. 11 and 12, according to certain embodiments of the invention, the produce container cover 10 may comprise tab slots 14 configured to fit over the tabs of the produce container and create a lock with the hook portion of the tabs. For example, the tab slots of the produce container cover may be shaped like an ellipses which is approximately the length of the base of the tab or only slightly longer. This allows the tab slot 14 to easily fit over the tab 54 by slipping the tab slot over the hook portion 56 of the tab first. This also creates a lock between the produce container 50 and the produce container cover 10 because the length of the tab and hook combined is slightly greater than the length of the tab slot. This prevents the produce container cover from inadvertently falling of the produce container during shipping and handling, despite vibrations and other disturbances. It should be understood that the tab slots may comprise numerous other shapes, including but not limited to rectangular, oval, and semi-circular and others, and still achieve the desired locking effect. In order to remove the produce cover container, the tab slot may be manipulated over the hook end of the tab, releasing the produce container cover.

Figure 5:
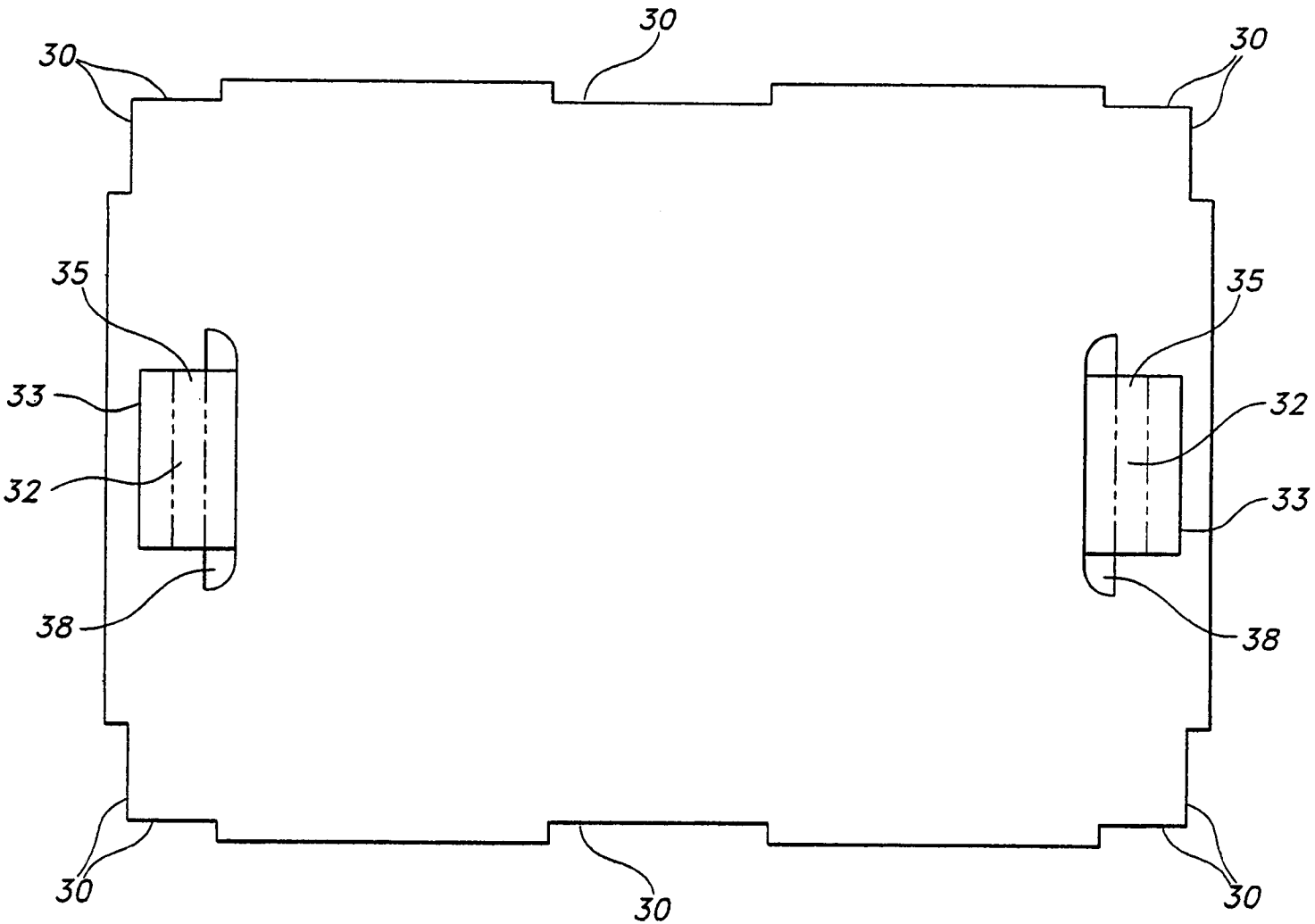
FIG. 5 is a top plan view of a produce container cover according to certain embodiments of the present invention.

Certain embodiments of the present invention may also be used with RPC containers 75, as shown in FIGS. 5–8. RPC containers have historically been used as open-top containers, exposing the produce to dust, light exposure, contamination and pilferage. The RPC containers 75 are made from a durable plastic material and have a bottom surface, two side walls 78 and two end walls 80. A handle opening 82 is located near the top center of each end wall to allow users to lift and handle the containers. As shown in FIG. 5, produce container covers according to certain embodiments of the present invention are made from a rectangular sheet of fiberboard. The edges of the fiberboard sheet may be cut to match the contour of the top of the RPC containers. For example, the RPC containers typically comprise a plastic rib 84 extending slightly into the opening of the container at each corner and at approximately the mid-point of each side wall. Accordingly, as shown in FIG. 5, notches 30 may be cut at each corner and the mid-point of the side portions of the produce container covers.

A locking tab 32 is die-cut on each end of certain embodiments of the produce container cover and extends towards the center of the cover. The locking tabs are connected to the produce container cover by a fold line 33 and each comprise a tab neck 35 and a tab head 38 which is slightly wider than the tab neck. The locking tab is preferably cut so that the width of the tab neck is approximately the same as the width of the handle opening of the RPC container. The tab head is therefore preferably slightly wider than the handle opening.

After filling the RPC container with produce, certain embodiments of the present invention may be used to cover the RPC container by placing the produce container cover on top of the RPC container so that it matches the contour of the top of the RPC container. After the produce container cover is positioned on top of the RPC container, the locking tabs may be folded downward along the fold line 33 into the RPC container and the tab head passed through the handle opening of the RPC container. It should be understood that the tab head 38 may need to be bent slightly to fit through the handle opening. Once the tab head has passed through the handle opening, the tab head may be folded upward along the top edge of the RPC container, above the handle opening. This creates a locking effect for the produce container cover, preventing the produce container cover from being displaced due to vibration, wind or handling. The greater width of the tab head makes it resistant to inadvertently passing through the handle opening, securing the produce container cover to the RPC container. The locking tabs create a smooth surface on the interior of the container, preventing damage to the produce. The void created by the locking tabs allows visual access to the packaged produce and ventilation. It should be understood that the locking tabs may be located on the sides of the produce container cover corresponding to handle openings located on the sides of RPC containers if desired.

Figure 6:
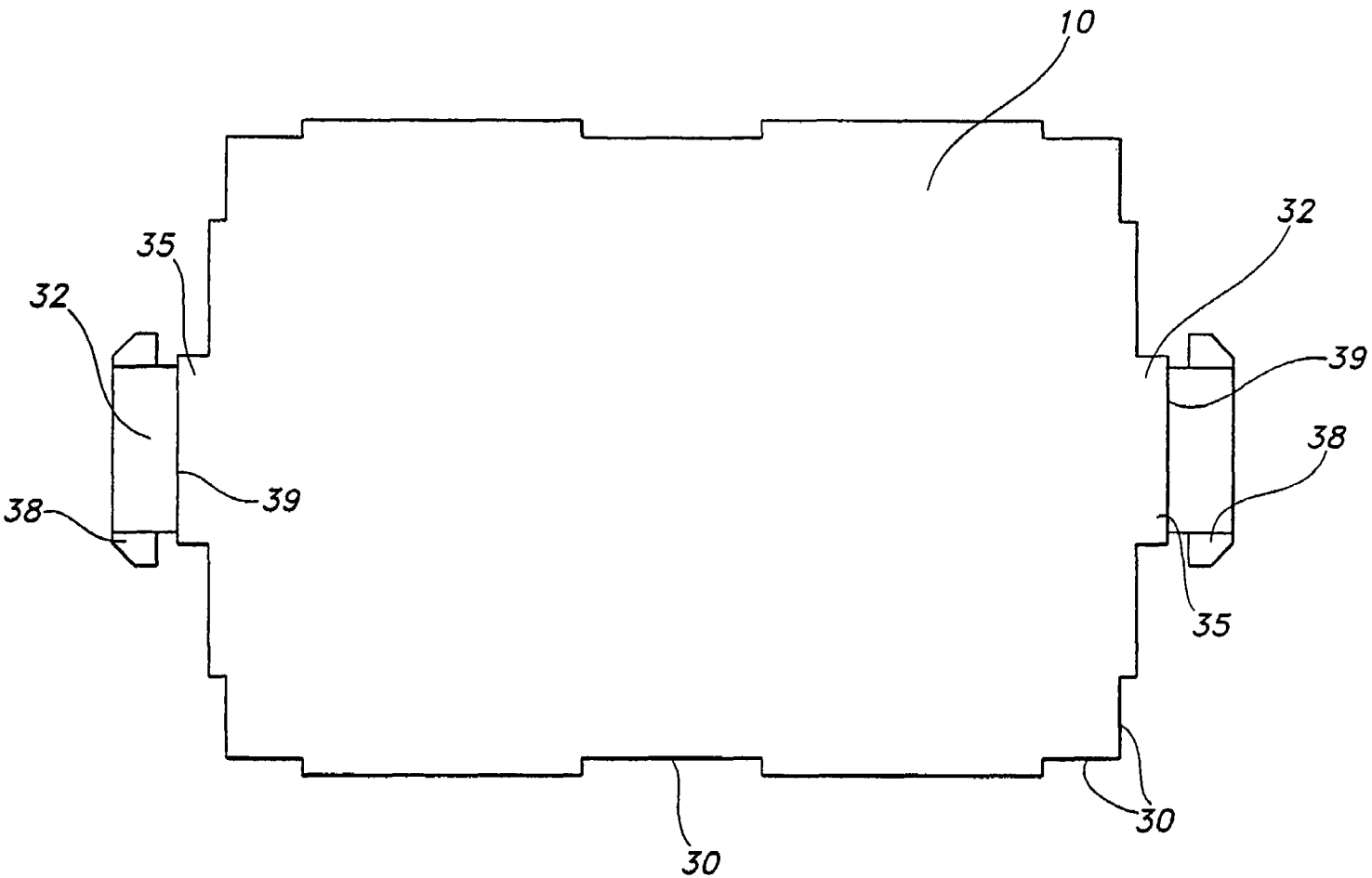
FIG. 6 is a top plan view of a produce container cover according to certain embodiments of the present invention.
Figures 7, 13:
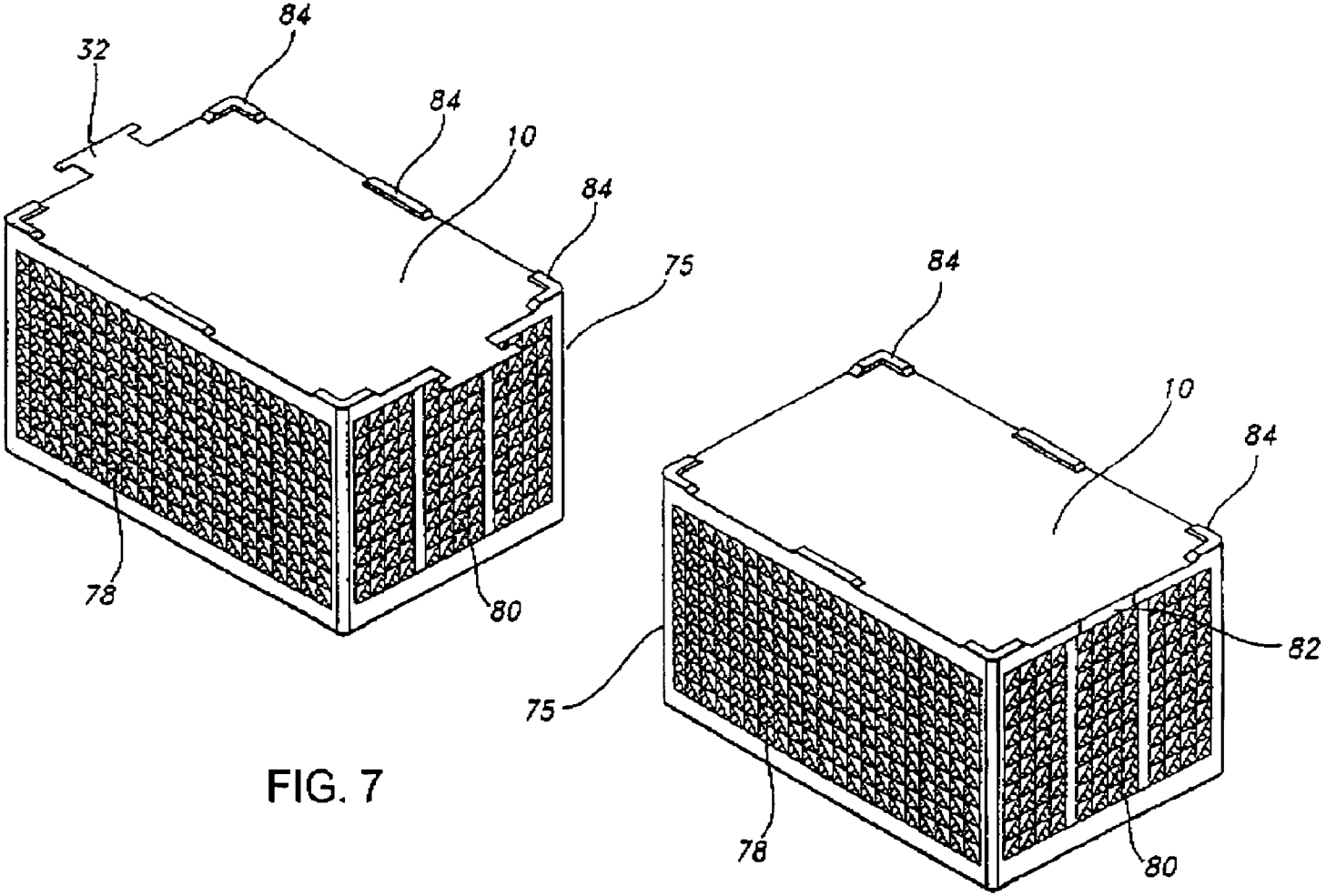
FIG. 7 is a perspective view of a produce container and produce container cover according to certain embodiments of the present invention.
FIG. 13 is a perspective view of a produce container and produce container cover according to certain embodiments of the present invention.
Figure 8:
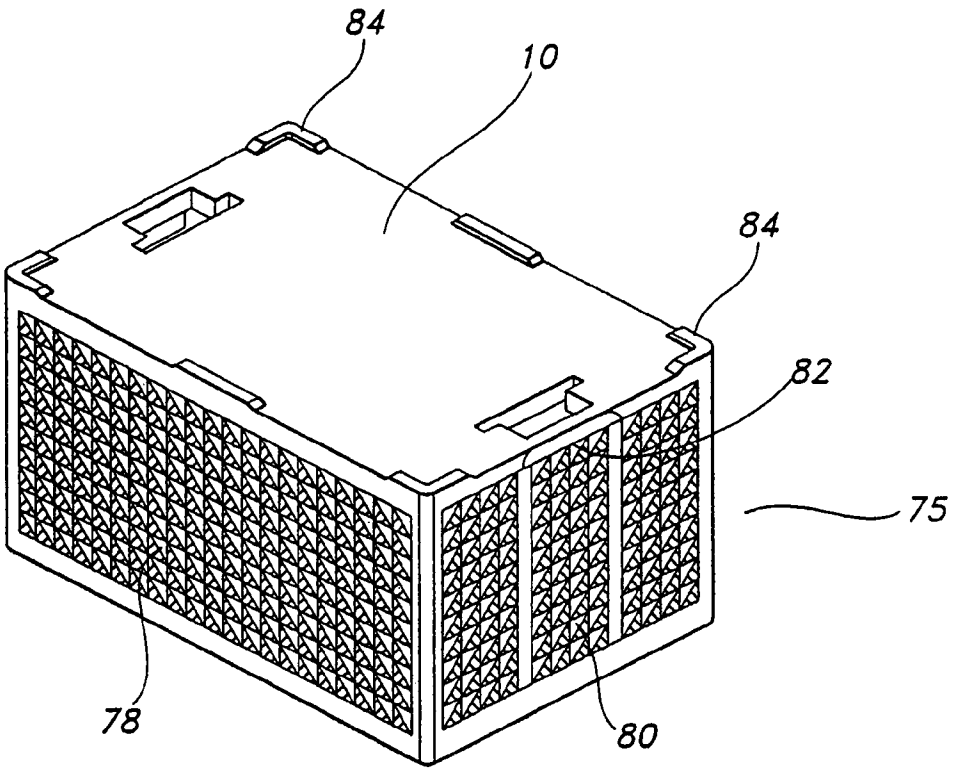
FIG. 8 is a perspective view of a produce container and produce container cover according to certain embodiments of the present invention.
Figure 9:
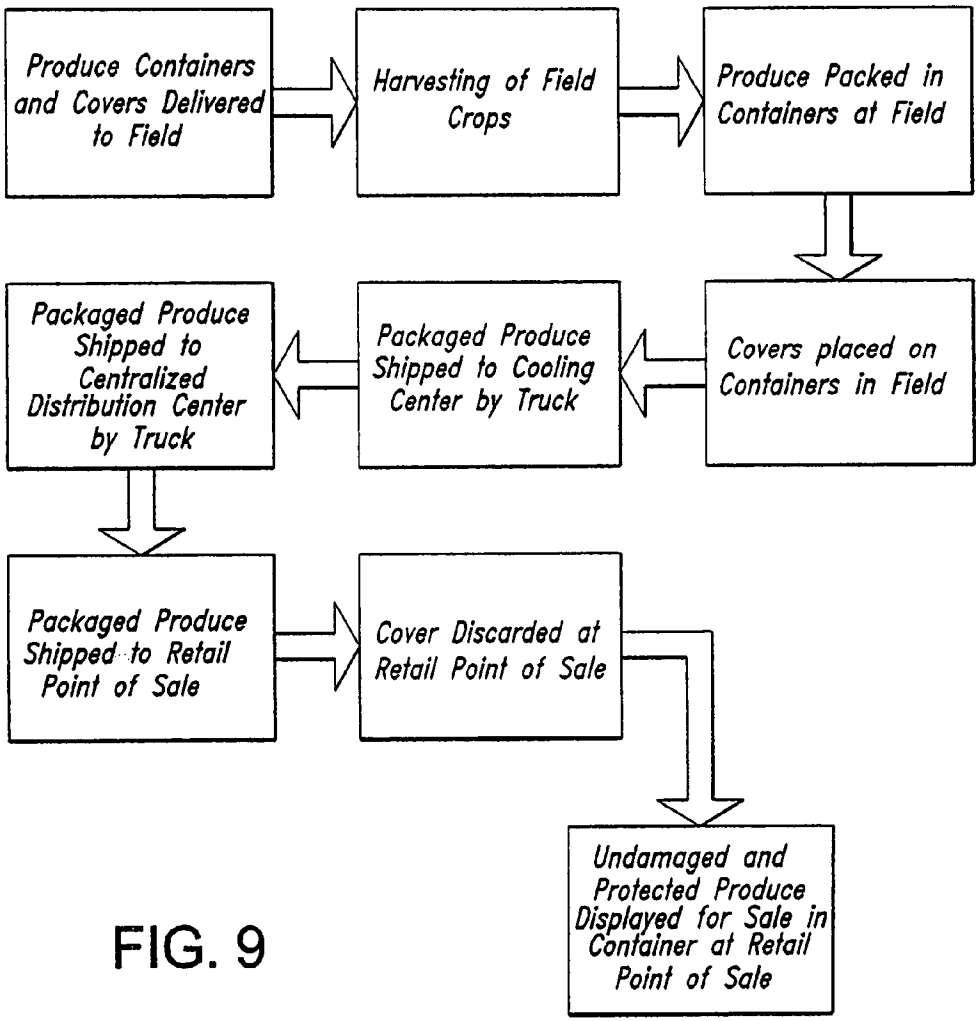
FIG. 9 is a flow chart of a process for packaging and transporting fresh produce from an agricultural field to a retail point of sale according to certain embodiments of the present invention.

According to certain embodiments of the present invention, the locking tabs may extend from the edges of the produce container and extend outward, away from the center of the cover, as shown in FIG. 6. The tabs are die-cut around the outer edge of a fiberboard sheet, preferably used to make the produce container cover. Each tab comprises a tab neck 35, which is connected to the produce container cover along a fold line 36, and a tab head 38 connected to the tab neck along a fold line 39. The tab neck is preferably the same width as the handle opening of the RPC container and the tab head is preferably slightly wider than the tab neck. The locking tabs according to certain embodiments of the present invention may be folded downward, and the tab head passed through the handle openings of the RPC container. Once the tab head has passed through the handle opening, the tab head may be folded upward along the top, inside edge of the RPC container, above the handle opening, creating a locking effect for the produce container cover. The greater width of the tab head makes it resistant to inadvertently passing through the handle opening, securing the produce container cover to the RPC container. It should be understood that the locking tabs may be located on the sides of the produce container cover corresponding to handle openings located on the sides of RPC containers if desired. It should also be understood that certain embodiments of the present invention may cover only a portion of the produce container if desired.

Certain embodiments of the present invention may be a process for shipping produce in covered containers from the field to a retail point of sale. According to certain embodiments of the present invention, the produce container covers may be shipped from a distribution center to the field, preferably by the pallet. The produce is harvested in the field and packed in containers. The containers may be corrugated produce containers, RPC containers or other types of containers such as Styrofoam. Once the produce has been packed in the containers, the containers may be covered with produce container covers which are locked onto the containers. The packaged produce, which is covered, is preferably loaded onto a truck for shipping to a cooling center. As described above, the use of fiber board or other suitably thin produce container covers allow an extra row of shipping containers to fit on a shipping truck. The packaged produce is cooled at the cooling center and then preferably shipped to a centralized distribution center by truck. The centralized distribution center gathers information from retail points of sale regarding the need for certain produce items. The packaged produce is shipped accordingly to the appropriate retail point of sale from the centralized distribution center, preferably by truck. Once the packaged produce arrives at the retail point of sale, it is unloaded from the truck and the produce container covers are discarded. The produce arrives at the retail point of sale protected from dust and other contaminants, has not been exposed to unwanted light, has not been bruised by the cover and has avoided pilferage. The produce may be displayed at the retail point of sale in the containers or may be removed from the container and displayed separately. It should be understood that the packaged produce may be shipped directly from the cooling center to a retail point of sale if so desired.

What is claimed is:

1. An apparatus for shipping fresh produce that prevents contamination of the produce caused by dust and direct contact with sunlight, the apparatus comprising:

a produce container comprising a bottom surface, two upstanding side walls extending upwards from side edges of the bottom surface and two upstanding end walls extending upwards from the bottom surface and at least one opening located in the bottom of the produce container;

a plurality of tabs extending from the top of either the side walls or the end walls of the produce container, at least one of the tabs comprising a base portion and a hook end;

a generally rectangular produce container cover for covering the majority of the produce container, the produce container cover comprising a plurality of tab slots whereby the tab slots are approximately slightly longer than the length of tab base, the tab slots of the produce container cover fitting over the tabs of the produce container and creating a positive lock with the at least one tab having a hook end securing the produce container cover to the produce container during shipping and handling of the produce and wherein the produce container cover is configured to form a gap between the edges of the produce container cover and at least one of the walls of the produce container providing ventilation and visual access to the packaged produce.

2. The apparatus of claim 1, wherein the produce container cover comprises fiberboard.

3. The apparatus of claim 1, wherein the produce container comprises corrugated.

4. The apparatus of claim 1, wherein the produce container comprises four tabs, each tab comprising a hook end.

5. The apparatus of claim 4, wherein the tabs extend upward from the side walls of the produce container.

6. The apparatus of claim 1, wherein the produce container cover comprises a flexible lightweight material that does not damage the packaged produce.

7. A produce container cover for covering produce packaged in a produce container, comprising:

a generally rectangular fiberboard sheet comprising a plurality of tab slots located towards edges of the fiberboard sheet, the tab slots comprising an aperture having a slit on either end;

whereby the tab slots may be placed over tabs located on produce containers used for shipping produce, the tab slots creating a friction fit between the produce container cover and the produce container and wherein the produce container cover does not damage the packaged produce, the produce container cover configured to form a gap between the edges of the produce container cover and at least one of the walls of the produce container providing ventilation and visual access to the packaged produce.

* * * * *